United States Patent [19]

McLoud

[11] Patent Number: 4,568,025

[45] Date of Patent: Feb. 4, 1986

[54] FIREFIGHTING NOZZLE

[76] Inventor: Donald H. McLoud, Box 111B, Savannah, N.Y. 13146

[21] Appl. No.: 616,079

[22] Filed: Jun. 1, 1984

[51] Int. Cl.[4] ..... B05B 1/34

[52] U.S. Cl. ..... 239/467; 239/469; 239/524; 169/37

[58] Field of Search ..... 239/467, 465, 468, 469, 239/524, 514; 169/16, 66, 67, 68, 70, 37

[56] References Cited

U.S. PATENT DOCUMENTS

| | | | |
|---|---|---|---|
| 429,464 | 6/1890 | Merrill | 239/514 |
| 2,692,649 | 10/1954 | McCreary | 169/68 |
| 3,693,886 | 9/1972 | Conrad | 239/468 |

FOREIGN PATENT DOCUMENTS

| | | | |
|---|---|---|---|
| 1531648 | 5/1968 | France | 239/524 |
| 0584899 | 12/1977 | U.S.S.R. | 239/469 |

*Primary Examiner*—Andres Kashnikow
*Assistant Examiner*—Scott D. Malpede
*Attorney, Agent, or Firm*—Bruns and Wall

[57] ABSTRACT

A spray nozzle for combating fires that includes a housing having a flat end face and a contoured chamber passing upwardly through the end face. A plate is supported adjacent to the end face to provide a circular spray opening therebetween. A fire extinguishing fluid is pumped through a rigid pipe from a high pressure supply into the chamber where the fluid is expanded into a vortex before being projected through the spray opening in a 360° pattern. The pipe enables the nozzle to be inserted into the fire region by a firefighter situated at a remote and relatively safer location.

5 Claims, 3 Drawing Figures

FIREFIGHTING NOZZLE

BACKGROUND OF THE INVENTION

This invention relates to an improved spray nozzle for combating well developed fires and, in particular a fire that is so intense that it must be battled from a remote somewhat distant location.

Often times, for example, firefighters find that they are unable to enter a burning structure because of intense heat and smoke. Under these conditions water and/or chemicals are sprayed into the structure from the outside through access openings, such as windows or the like. Water is generally supplied from a pump under pressure by a hose and is directed at the fire through means of a nozzle capable of handling the pressure. The projected fluid is concentrated by the nozzle into a relatively narrow stream so that it can travel the distance spanning the firefighter and the blaze. The concentrated spray is capable, however, of only wetting a small area within the target region at any one time. As a consequence, the equipment is not highly effective. Similarly, the high pressure spray tends to break up into fine droplets as it moves through the air towards the target area. The small droplets, when exposed to intense heat, quickly evaporate thus limiting the amount of fire extinguishing fluid that actually reaches the target. Furthermore, it is extremely difficult to direct a concentrated spray onto a target over long distances, particularly where the target is obscured by smoke or an intervening wall.

Many of the nozzles that are used in conjunction with present day firefighting apparatus, are highly sophisticated pieces of equipment containing a variety of sensitive parts such as complex valves and seals which can be damaged when exposed to high temperatures for extended periods of time. If these heat sensitive nozzles are placed directly within a fire or, alternatively close to a high intensity blaze, the sensitive components can become damaged to a point where the nozzle will no longer function properly. As a consequence, the more sensitive nozzles ordinarily are used to combat fires over long distances where they will be shielded from the fire.

SUMMARY OF THE INVENTION

It is therefore an object of the present invention to improve nozzles used to combat high intensity blazes.

It is a further object of the present invention to provide a nozzle that can be accurately positioned within a burning region by a firefighter stationed at a remote position.

A still further object of the present invention is to provide a relatively heat impervious spray nozzle that can deliver a 360° spray pattern directly into the center of a fire.

Another object of the present invention is to provide a nozzle for providing a 360° spray of fire extinguishing fluid which has no moving or heat sensitive part that can be damaged when exposed to high temperatures.

These and other objects of the present invention are attained by means of a spray nozzle that includes a heavy, heat impervious metal housing having a flat end face and a tapered chamber passing upwardly through the end face. A center post is situated within the chamber that protrudes to or beyond the plane of the end face. A heavy metal plate is secured to the distal end of the post that acts in conjunction with the housing to establish a radially disposed opening that extends about the entire periphary of the housing. A fire extinguishing fluid is introduced into the upper part of the chamber under pressure so that the fluid expands into a vortex as it moves down the chamber and is eventually discharged through the peripheral opening to create a circular spray pattern encircling the nozzle.

BRIEF DESCRIPTION OF THE DRAWING

For a better understanding of these and other objects of the present invention reference is had to the following detailed description of the invention which is to be read in conjunction with the following drawings, wherein.

DESCRIPTION OF THE INVENTION

Turning now to the drawings, there is shown a spray nozzle, generally referenced 10, that embodies the teachings of the present invention that is adapted to deliver a fire extinguishing fluid directly into a blaze. As noted above, the present nozzle is fabricated entirely from metal parts that are relatively impervious to high temperatures. Furthermore, the present nozzle contains no moving parts, such as valves or seals, that could be damaged or rendered unusable when the nozzle is exposed to high temperatures for long periods of time. Accordingly the nozzle can be placed directly into an involved region where, because of its heat resistant properties, it can operate safely and continually over long periods of time to combat the fire at its source where it can do the most good. As will be explained in greater detail below, the apparatus of the present invention is arranged to introduce a fire extinguishing liquid, such as water, into a wide 360° area.

Figure 2:
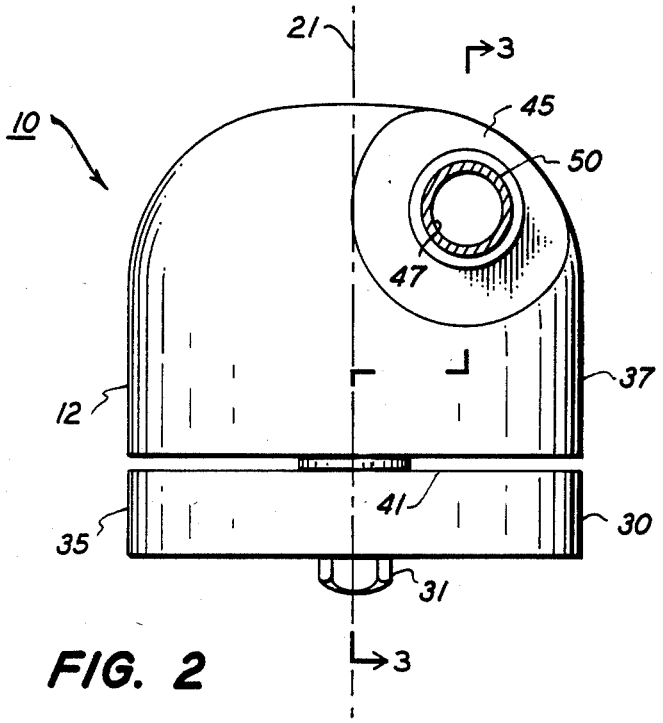
FIG. 2 is a side elevation of a spray nozzle shown in FIG. 1 which embodies the teachings of the present invention.
Figure 3:
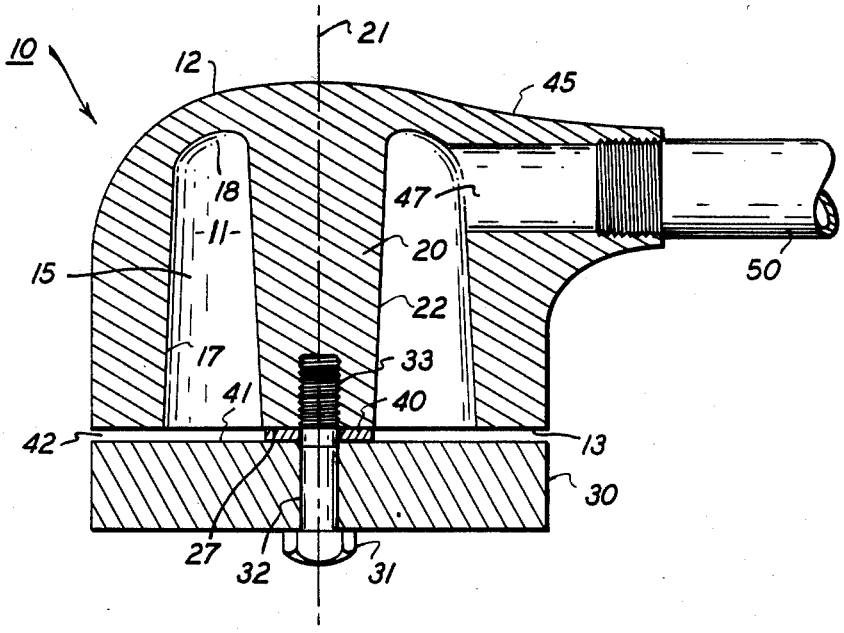
FIG. 3 is a sectional view of the instant spray nozzle along lines 3—3 in FIG. 2.

Turning now to FIGS. 2 and 3, the nozzle includes a heavy metal housing 12 that is cast or otherwise formed from a single piece of heat impervious material contoured to resemble a hemisphere. The housing 12 contains a flat, smooth end face 13 that forms the bottom surface of the housing. A circular shaped chamber 15 passes upwardly through the end face of the housing. The sidewall 17 of the chamber tapers inwardly from the end face 13 toward the bottom wall 18 of the chamber so that the outer geometry of the chamber basically describes a truncated cone.

A tapered post 20 is centered within the chamber so that the post is axially aligned along the central axis 21 of the chamber. The outer geometry of the post also describes having an outer wall 22 that tapers from the bottom wall 18 of the chamber towards the distal end 27 of the post. The degree of taper of the post is substantially equal to that of the side wall 17 of the chamber whereby the interior opening 11 of the chamber expands uniformly from the bottom wall 18 to the lower chamber entrance at end face 13. The post 20 terminates in a plannar surface 27 that lies in the plane of the flat end face 13.

A heavy circular plate or plate 30 is removably secured to the bottom of the housing by means of a bolt 31. The bolt passes through a centrally located hole 32 formed in the plate and is received with a threaded hole 33 that is axially formed within the post 20. The outer periphary 35 (FIG. 2) of the plate complements the outer periphary 37 of the housing 12 so that the outer surface of the nozzle presents a relatively smooth unbroken surface to anything that it comes in contact with. An annular spacer 40 is positioned between the bottom surface 27 of the post and the top surface 41 of the plate. The spacer functions to locate the top wall surface 41 of the plate a predetermined distance from the end face 13 of the housing and thus establishes a circular 360° opening 42 radially disposed about the nozzle that can communicate directly with the interior of the expanded chamber 15.

A fluid inlet section, generally referenced 45, is positioned in the upper part of the housing. The inlet section is integral with the housing and contains an inlet passage 47 that enters the chamber 15 immediately adjacent to the bottom wall 18. The passage is generally perpendicular aligned with the axis 21 of the housing. A rigid pipe 50 is threaded into the outer entrance to the passage and serves to deliver a fire extinguishing fluid directly into the chamber through the inlet passage. The inlet section, as shown in FIG. 2, is offset from the central axis 21 of the housing so that the entering fluid is directed into the expanded chamber opening rather than against the post 20. As a result, the incoming stream of fluid is turned by the contoured circular walls of the chamber into a vortical or circular flow. The fluid, which typically enters the chamber under a relatively high pressure, is allowed to expand as it moves down the chamber towards the lower nozzle opening 42. This expansion produces an increase in the fluid velocity as it approaches the opening causing the fluid to issue from the housing at a relatively high speed. Accordingly, a radially directed circular spray pattern is developed that moves outwardly from the center of the housing in a full 360° pattern which covers a relatively wide area.

The width of the spray opening, and thus the geometry of the spray pattern generated by the nozzle, can be selectively altered by changing the size of the spacer 40. By using a relatively thin spacer, a wide spray pattern can be developed which is made up of relatively fine droplets. The use of a thicker spacer, on the other hand, will reduce the radius of the spray pattern while increasing the droplet size. Alternatively, the number of component parts of the nozzle can be reduced by eliminating the spacer. In this embodiment, the length of the post is extended so that it protrudes a predetermined distance out beyond the end face 13 of the housing. The plate 30 is then bolted directly against the extended end face of the post to position the plate a predetermined distance away from the end face 13 of the housing thus establishing a desired width spray opening. The width can be set at some optimum value that will produce an optimum spray pattern. The width of the opening may be increased by simply inserting a spacer as described above between the extended post and the plate.

Figure 1:
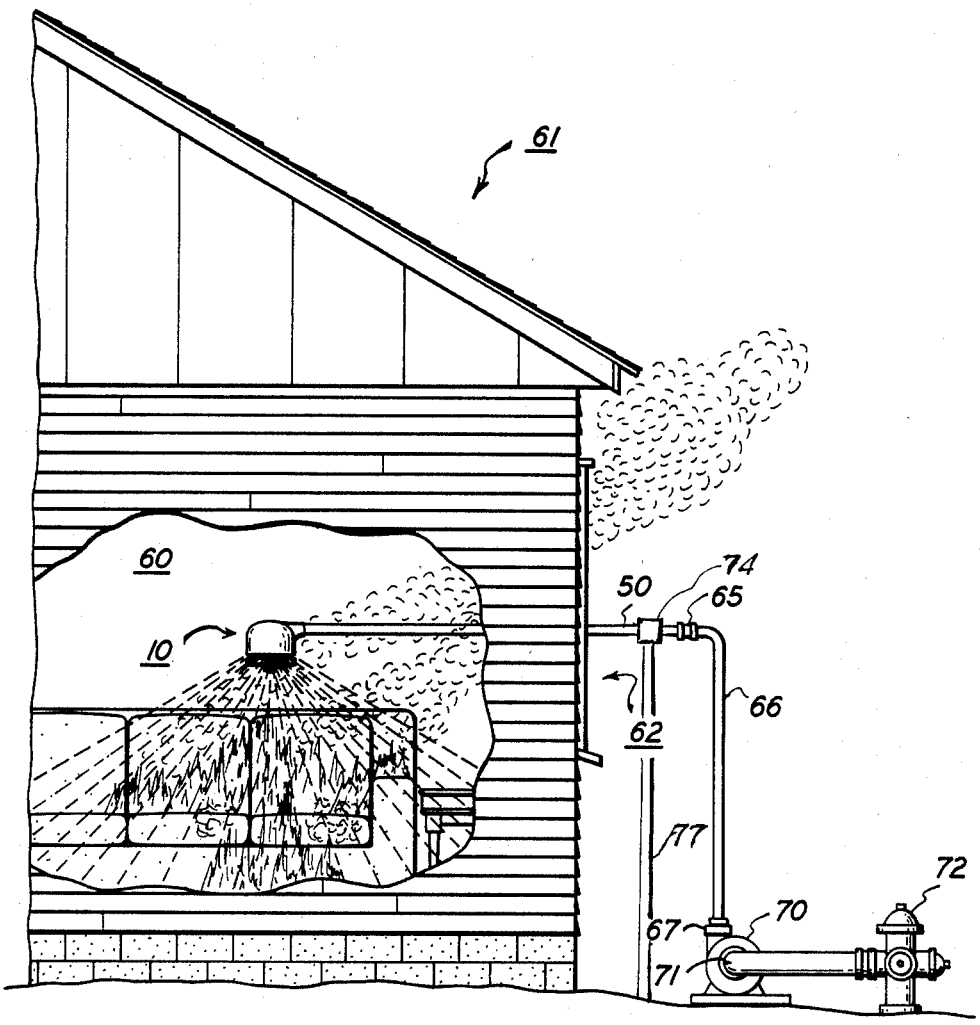
FIG. 1 is partial side elevation showing a burning structure with portions broken away to more clearly illustrate the apparatus of the present invention situated in the blaze region.

As illustrated in FIG. 1, the nozzle 10 is typically supported upon the end of an elongated rigid pipe 50 which is of sufficient length to permit the nozzle to be inserted into a burning building 61 or the like by a firefighter who is situated a safe distance from the building. As illustrated the fire may be located in one room 60 of the building having a window 62 or any other type of access opening through which the nozzle can pass. A coupling 65 is provided at the end of the pipe 50 by which the pipe is connected to a flexible piece of fire hose 66. In this case, the fire hose is attached to the discharge end 69 of a pump 70 while the suction end 71 of the pump is arranged to draw water from a standard fire hydrant 72 and deliver it to the nozzle under increased pressure. A support standard 77 having a swivel head 74 for containing the pipe 50 is used to help support the nozzle at a desired elevation and to help direct the nozzle inside the structure. As can be seen, the nozzle can be easily maneuvered from outside to place a wide blanket of water directly over the burning region where it can most effectively combat the blaze.

While this invention has been described with reference to the structure disclosed herei, it is not confined to the details set forth and this application is intended to cover any modifications or changes as may come within the scope of the following claims.

I claim:

1. A spray nozzle for combating fires that include a hemisphere shaped housing formed of heat impervious metal whereby the housing can be placed directly into a fire, said housing having a flat planar end face that is perpendicular to the axis of the hemisphere, said housing further including a conical shaped chamber passing inwardly through said end face, said chamber being aligned along the axis of the hemisphere with the side wall thereof tapering inwardly from the end face toward its bottom wall, a tapered post aligned along the axis of the hemisphere within the chamber, said post being integral with said housing and being tapered inwardly from the bottom wall of the chamber toward the said end face whereby the chamber opening expands from the bottom wall toward the end face, a flat plate secured to the post adjacent to the said end face to form a radial disposed circumferential discharge opening therewith, and a fluid inlet means passing through the housing perpendicular to the axis of the hemisphere and entering the chamber tangent to the bottom wall thereof whereby fluid entering the chamber is shaped into an expanding radially disposed vortex prior to passing through the discharge opening.

2. The nozzle of claim 1 that further includes a threaded member for securing the plate to the post.

3. The nozzle of claim 2 that further includes a removable spacer means positioned between the post and the plate whereby the width of the discharge opening can be varied by changing the spacer.

4. The nozzle of claim 1 that further includes an elongated pipe that is threaded into the fluid inlet post whereby the nozzle can be passed into the fire from a remote location.

5. The nozzle of claim 1 wherein said fluid inlet port enters the chamber between the post and the side wall of said chamber.

* * * * *